US012716413B2

(12) United States Patent
Kay

(10) Patent No.: US 12,716,413 B2
(45) Date of Patent: Aug. 25, 2026

(54) PACKING STYLE PISTON ROD

(71) Applicant: GD Energy Products, LLC, Tulsa, OK (US)

(72) Inventor: Konner Casey Kay, Broken Arrow, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 182 days.

(21) Appl. No.: 18/508,511

(22) Filed: Nov. 14, 2023

(65) Prior Publication Data

US 2025/0154948 A1 May 15, 2025

(51) Int. Cl.

| | |
|---|---|
| ***F04B 53/02*** | (2006.01) |
| ***F04B 53/14*** | (2006.01) |
| ***F04B 53/16*** | (2006.01) |
| *E21B 43/26* | (2006.01) |
| *F04B 53/18* | (2006.01) |

(52) U.S. Cl.

CPC ..... *F04B 53/02* (2013.01); *F04B 53/14* (2013.01); *F04B 53/143* (2013.01); *F04B 53/166* (2013.01); *E21B 43/2607* (2020.05); *F04B 53/18* (2013.01)

(58) Field of Classification Search

CPC ..... F04B 53/02; F04B 53/14; F04B 53/143; F04B 53/166; F04B 53/162–168; F04B 53/22; F04B 1/0421; F04B 53/128; E21B 43/2607

USPC ..... 92/182

See application file for complete search history.

(56) References Cited

U.S. PATENT DOCUMENTS

| | | | | |
|---|---|---|---|---|
| 1,806,078 | A * | 5/1931 | Miller | F04B 53/143 92/206 |
| 2,517,307 | A * | 8/1950 | Harbison | F16J 1/00 492/41 |
| 3,296,943 | A * | 1/1967 | Rosman | F16J 15/164 277/467 |
| 4,020,750 | A * | 5/1977 | Freimuth | F16J 1/06 277/467 |
| 4,270,440 | A | 6/1981 | Lewis, II | |
| 4,965,042 | A * | 10/1990 | Besic | F04B 53/164 417/900 |
| 9,027,934 | B2 | 5/2015 | Lindner-Silwester et al. | |
| 9,581,154 | B2 * | 2/2017 | Wang | F04B 53/148 |
| 10,465,678 | B2 | 11/2019 | Wrobel et al. | |

(Continued)

FOREIGN PATENT DOCUMENTS

| | | | | |
|---|---|---|---|---|
| CN | 113482911 A | * 10/2021 | | F04B 53/22 |
| WO | WO-2008131430 A1 | * 10/2008 | | F16J 1/008 |

OTHER PUBLICATIONS

Translation of CN-113482911-A (Year: 2021).*

*Primary Examiner* — Charles G Freay

(74) *Attorney, Agent, or Firm* — Edell, Shapiro & Finnan, LLC

(57) ABSTRACT

A frac/drilling style piston for a high-pressure reciprocating pump. The piston assembly includes a piston that can achieve higher pressures than traditional style pistons. By delivering lube oil to a lantern ring and packing style seals, lubrication of the packing can be accomplished more effectively. In addition, the heat generated between the seal material and the dynamic sealing surface is mitigated more effectively as well. By achieving those items more effectively, the pump can operate at a higher pressure without burning up the packing.

20 Claims, 8 Drawing Sheets

(56) References Cited

U.S. PATENT DOCUMENTS

| | | | | |
|---|---|---|---|---|
| 11,261,863 | B2 * | 3/2022 | Beisel | F04B 53/16 |
| 11,326,693 | B2 * | 5/2022 | Netecke | F16J 15/56 |
| 2008/0230998 | A1 | 9/2008 | Adler et al. | |
| 2008/0257143 | A1 * | 10/2008 | Leman | F04B 53/143 92/255 |
| 2020/0003205 | A1 | 1/2020 | Stokkevag et al. | |
| 2020/0386218 | A1 | 12/2020 | Feistel | |

* cited by examiner

PACKING STYLE PISTON ROD

FIELD OF INVENTION

The present invention relates to the field of high-pressure reciprocating pumps and, in particular, to a frac/drilling style piston for high-pressure reciprocating pumps.

BACKGROUND

High-pressure reciprocating pumps are often used to deliver high-pressure fluids during earth drilling operations. Pumps of this type typically include a fluid end having an internal pressure chamber in communication with a fluid inlet and a fluid outlet. Fluid is drawn into the pressure chamber via the fluid inlet and expelled from the pressure chamber via the fluid outlet by reciprocating movement of one or more pistons.

Pistons generate a significant amount of friction/hear that can impact the piston life. The higher the operating pressure, the more friction the piston generates. Additionally, once a conventional piston begins to leak, that piston has to be replaced.

Conventional frac pumps utilize a plunger with packing style seals and a lantern ring to achieve the pressures necessary for frac operations. These plunger style systems provide lubricating oil through the stuffing box.

SUMMARY

The present application relates to techniques for a frac/drilling style piston for a reciprocating pump, which allow the piston to achieve higher pressures than traditional style piston.

More specifically, in accordance with at least one embodiment, the present application is directed to a piston assembly for a reciprocating pump with a power end and a fluid end. The piston assembly comprises a hollow cylindrical liner having a longitudinal axis, and an inner surface, a piston disposed within the hollow cylindrical liner, the piston having its own longitudinal axis, the piston being configured to be coupled with the power end of the reciprocating pump, the piston having an outer surface and an internal passageway extending along its longitudinal axis, and packing disposed on the piston and positioned in contact with the outer surface of the piston, and the packing engages the inner surface of the hollow cylindrical liner when the piston is inserted into the hollow cylindrical liner, wherein a fluid can be supplied through the internal passageway.

In an embodiment, the piston assembly further comprises a lantern ring disposed on the piston, the internal passageway having an outlet, wherein the fluid passes through the outlet to the lantern ring.

In another embodiment, the piston assembly further comprises a distal ring disposed on the piston, and a threaded nut disposed on the piston, wherein the packing and the lantern ring are located between the threaded nut and the distal ring.

In an embodiment, each of the distal ring and the threaded nut is engaged with the outer surface of the piston, and the threaded nut is adjustable so that it can be moved along the outer surface of piston.

In another embodiment, the threaded nut includes an inner surface with a first set of threads, the outer surface of the piston includes a second set of threads, and the second set of threads and the first set of threads are engageable to facilitate movement of the threaded nut relative to the piston.

In an embodiment, the packing includes a first packing element and a second packing element.

In another embodiment, the packing has an outer surface, and the outer surface of the packing engages the inner surface of the hollow cylindrical liner.

In an embodiment, the hollow cylindrical liner has a first end and a second end opposite to the first end, the hollow cylindrical liner has a thickness between its outer surface and its inner surface, and the thickness varies along the hollow cylindrical liner between the first end and the second end.

In an alternative embodiment, the hollow cylindrical liner has a first portion that has a first thickness and a second portion that has a second thickness, the second thickness is greater than the first thickness, and a part of the second portion of the hollow cylindrical liner is inserted into a bore of the fluid end.

In accordance with another embodiment, a piston assembly for a reciprocating pump with a power end and a fluid end, the piston assembly comprises a hollow cylindrical liner having a longitudinal axis, and an inner surface, a piston disposed within the hollow cylindrical liner, the piston having its own longitudinal axis, the piston being configured to be coupled with the power end of the reciprocating pump, the piston having an outer surface and an internal passageway extending along its longitudinal axis, and packing disposed on the piston and positioned in contact with the outer surface of the piston, and the packing engages the inner surface of the hollow cylindrical liner when the piston is inserted into the hollow cylindrical liner, wherein a fluid can be supplied through the internal passageway.

In an embodiment, the piston assembly further comprises a lantern ring disposed on the piston, the internal passageway having an outlet, wherein the fluid passes through the outlet to the lantern ring, a distal ring disposed on the piston, and a threaded nut disposed on the piston, wherein the packing and the lantern ring are located on the outer surface of the piston and between the threaded nut and the distal ring.

In another embodiment, the threaded nut includes an inner surface with a first set of threads, the outer surface of the piston includes a second set of threads, and the second set of threads and the first set of threads are engageable to facilitate movement of the threaded nut relative to the piston.

In an embodiment, the piston, the threaded nut, the lantern ring and the packing can be removed collectively as a unit from the hollow cylindrical liner.

In accordance with another embodiment, a reciprocating pump comprises a power end, a fluid end including a bore formed therein, and a piston assembly having a first end and a second end opposite the first end, the first end of the piston assembly is coupled to the power end, the second end of the piston assembly is coupled to the fluid end. The piston assembly includes a hollow cylindrical liner having a longitudinal axis, and an inner surface, a piston disposed within the hollow cylindrical liner, the piston having an outer surface and an internal passageway extending therein, and packing disposed on the piston, the packing engaging the inner surface of the hollow cylindrical liner when the piston is inserted into the hollow cylindrical liner, wherein a fluid can be supplied through the internal passageway.

In an embodiment, the reciprocating pump further comprises a lantern ring disposed on the piston, the internal passageway having an outlet, wherein the fluid passes through the outlet to the lantern ring.

In another embodiment, the reciprocating pump further comprises a distal ring disposed on the piston, and a threaded nut disposed on the piston, wherein the packing and the lantern ring are located between the threaded nut and the distal ring.

In an alternative embodiment, each of the distal ring and the threaded nut is engaged with the outer surface of the piston, and the threaded nut is adjustable so that it can be moved along the outer surface of piston.

In another embodiment, the threaded nut includes an inner surface with a first set of threads, the outer surface of the piston includes a second set of threads, and the second set of threads and the first set of threads are engageable to facilitate movement of the threaded nut relative to the piston.

In another embodiment, the piston, the threaded nut, the lantern ring and the packing can be removed collectively as a unit from the hollow cylindrical liner.

In another embodiment, the hollow cylindrical liner has a first end and a second end opposite to the first end, the hollow cylindrical liner has a thickness between its outer surface and its inner surface, and the thickness varies along the hollow cylindrical liner between the first end and the second end.

Other features and advantages of the invention will be apparent from the specification and drawings.

BRIEF DESCRIPTION OF THE DRAWINGS

To complete the description and in order to provide for a better understanding of the present invention, a set of drawings is provided. In the drawings, like reference numerals in the various figures are utilized to designate like components. The drawings form an integral part of the description and illustrate embodiments of the present invention, which should not be interpreted as restricting the scope of the invention, but just as examples of how the invention can be carried out. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the piston assembly presented herein provides a piston that can achieve higher pressures than traditional style pistons. In general, pistons generate a significant amount of friction/hear that can impact the piston life. The higher the operating pressure, the more friction the piston generates. In one embodiment, by delivering lube oil to a lantern ring and packing style seals, lubrication of the packing can be accomplished more effectively. In addition, the heat generated between the seal material and the dynamic sealing surface is mitigated more effectively as well. By achieving those items more effectively, the pump can operate at a higher pressure without burning up the packing.

Additionally, as the packing around a piston wears and begins to leak, the piston assembly disclosed herein has a gland nut on the piston rod that can be tightened to get more useable life out of the packing stack.

A piston system pump offers some serviceability advantages over a plunger system. In a traditional plunger style fluid end, the plunger has to be removed through the suction cover face of the fluid end, and the packing has to be replaced from the cradle side of the pump, which is more challenging to access. Additionally, the dynamic sealing surface of the plunger system is the outer diameter of the plunger, which can be damaged if dropped or hit by a tool.

A piston style fluid end would allow the packing to be removed with the piston through suction cover face. As a result, the amount of space needed to access the pump cradle is mitigated and minimized.

Additionally, with the ID of the piston liner being the dynamic sealing surface, it is less likely to be damaged by drops or by hitting another object. An additional benefit of the piston liner system is that the pumped fluid will wash over the surface of the piston liner, which may help cool the liner to prolong the life of the packing. Utilizing a piston described herein on a pump that already uses traditional style pistons would result in that pump achieving higher operating pressures than was previously possible.

Figure 1:
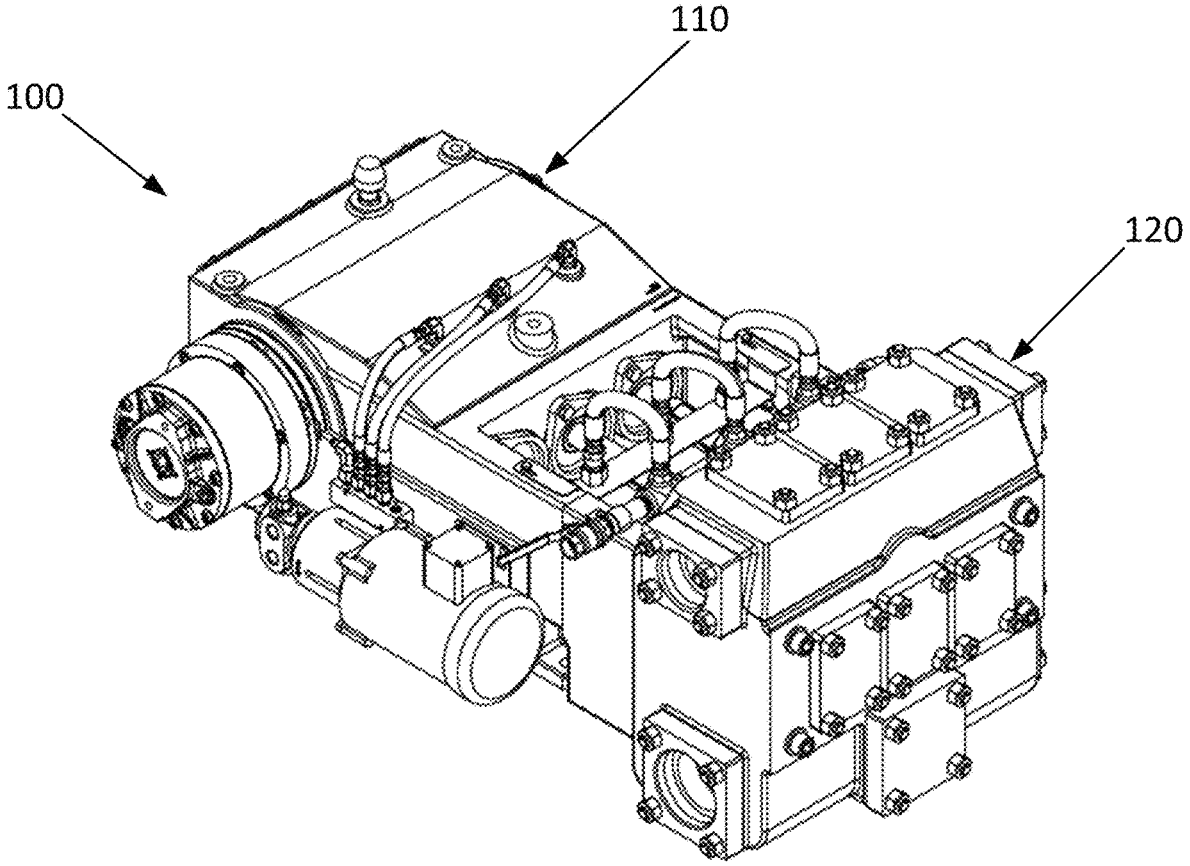
FIG. 1 is a perspective view of a reciprocating pump according to an example embodiment.

FIG. 1 shows an example embodiment of a reciprocating pump 100 in which the piston rod assembly presented herein may be included. The reciprocating pump 100 includes a power end 110 and a fluid end 120. The power end 110 of the pump 100 includes a crankshaft that drives a plurality of reciprocating pistons in communication with chambers in the fluid end 120 to pump fluid at high-pressure. Generally, the power end 110 of the pump is capable of generating forces sufficient to cause the fluid end 120 to pump fluids at pressures suitable for earth drilling operations, such as frac or oil and gas drilling operations.

A reciprocating pump utilizing the piston assembly presented herein may increase maximum fluid pressure and flow rate, without materially increasing the size and weight of the pump, such that the pump may be transported and setup in the normal manner. In an example, the reciprocating pump and piston assembly presented herein may increase maximum fluid pressure by as much as 50%-150% (e.g., to a maximum fluid pressure of 4,500 psi to 7,500 psi) and flow rate by as much as 15%-35%, or more (e.g., to an output flow of up to 1,000 gpm) without materially increasing the size or weight of the pump, such that the pump may be transported and setup using the same equipment currently used for conventional pumps. Additionally, since a reciprocating pump utilizing the piston assembly presented herein may allow for a larger diameter piston, the piston assembly presented herein may allow for geometric improvements in a fluid end (e.g., by enabling a larger range of bore spacing options, seal diameter options, etc.).

Figure 2:
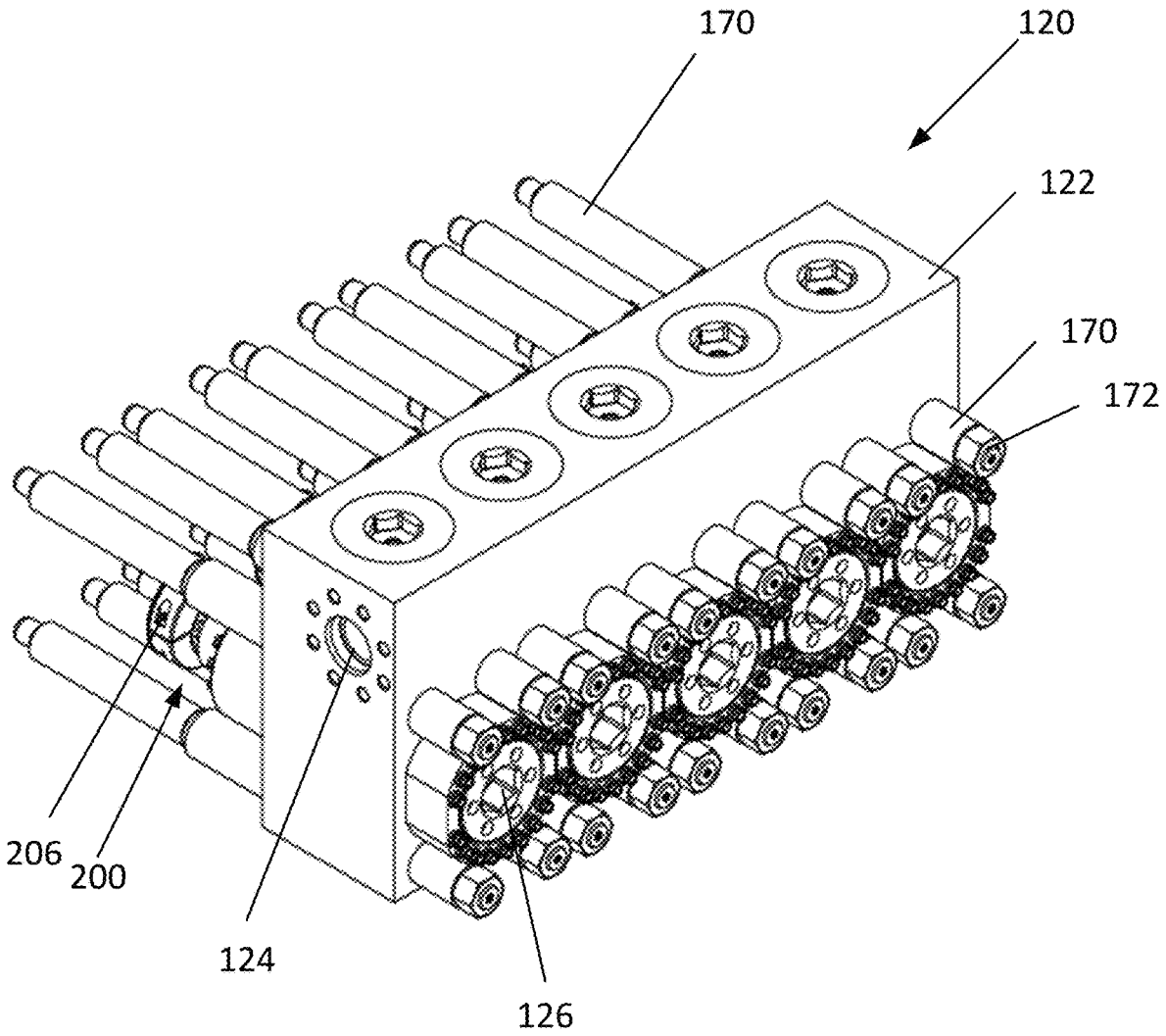
FIG. 2 is a perspective view of the fluid end of the reciprocating pump shown in FIG. 1.
Figure 3:
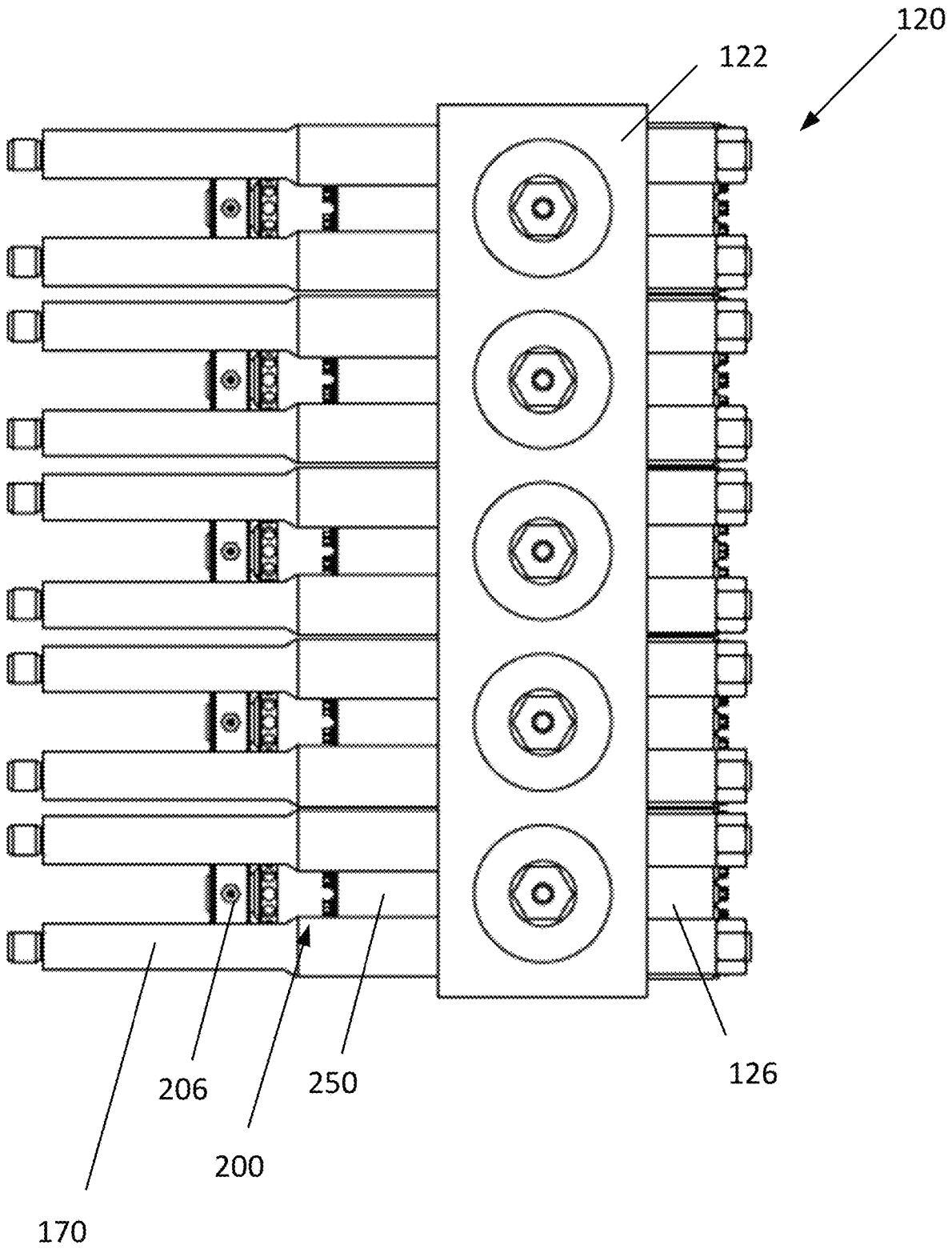
FIG. 3 is a top view of the fluid end and piston assemblies of the reciprocating pump shown in FIG. 1.
Figure 4:
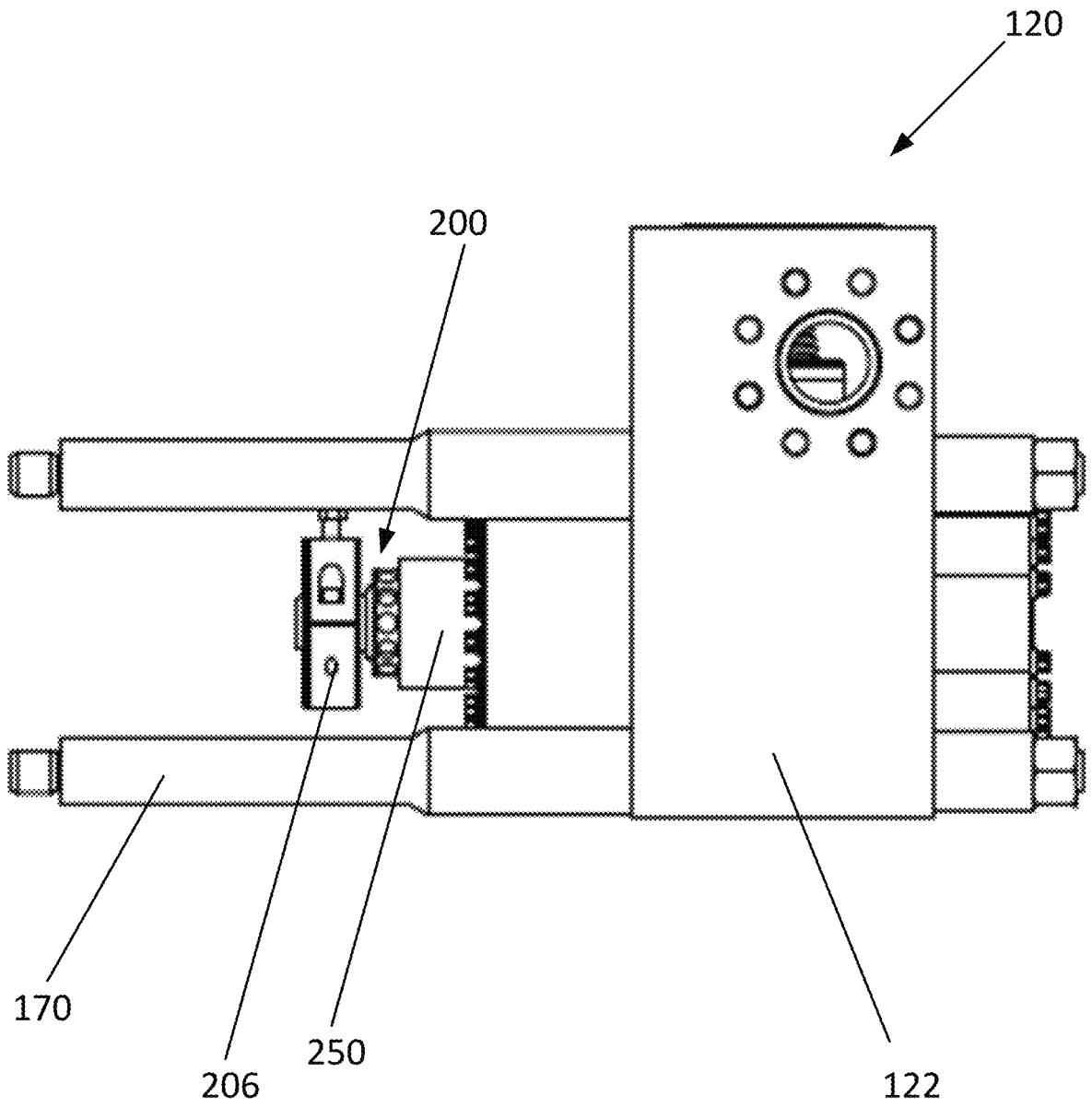
FIG. 4 is a side view of the fluid end and piston assemblies shown in FIG. 3.

Referring now to FIGS. 2-4, the fluid end 120 and piston assemblies of the reciprocating pump 100 are shown in greater detail. While the reciprocating pump 100 is shown with five piston assemblies, it will be appreciated that the principles presented herein may be applied to any reciprocating pump having one or more piston assemblies.

The fluid end 120 includes a fluid end casing 122 with several external openings, of which one of them is port 124. The fluid end casing 122 has several access covers 126 that are secured to the fluid end casing 122. Also shown are several couplers 170, such as stay rods or tie rods, that are coupled at one end to the power end 110 and extend through openings in the fluid end casing 122. The other ends of the couplers 170 extend outwardly from the fluid end casing 122, and are secured in place by fasteners 172, such as nuts.

In the perspective view illustrated in FIG. 2, a portion of one of the piston assemblies or piston rod assembles 200 is shown, while in FIG. 3, all five piston assemblies 200 are shown. The connecting member 206 is used to couple the piston or piston rod 250 to a reciprocating member (not shown) that is moved by the power end 110. The piston can be referred to alternatively as a piston rod. As a result, the piston 250 reciprocates when the power end 110 is driven. The piston or piston rod 250 can be referred to as a packing style piston or packing style piston rod, based on to the location of the packing relative to the piston 250 and the location of the dynamic sealing surface, as described below. Turning to FIG. 4, the location of the piston 250 and connecting member 206 relative to the couplers 170 is illustrated.

Figure 5:
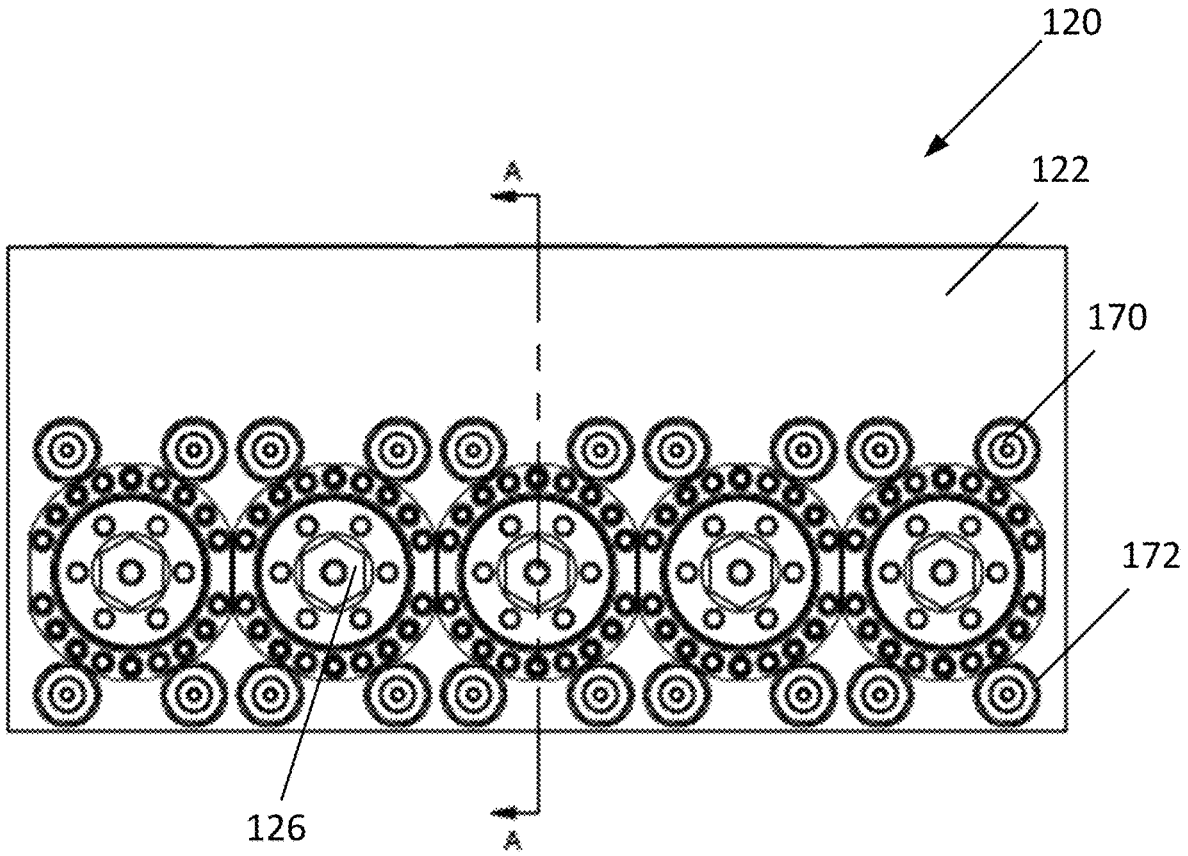
FIG. 5 is a front view of the fluid end of the reciprocating pump shown in FIG. 1.

Referring to FIG. 5, a front view of the fluid end 120 and the fluid end casing 122 is illustrated. The various couplers 170 and fasteners 172, as well as the access covers 126 are shown.

Figure 6:
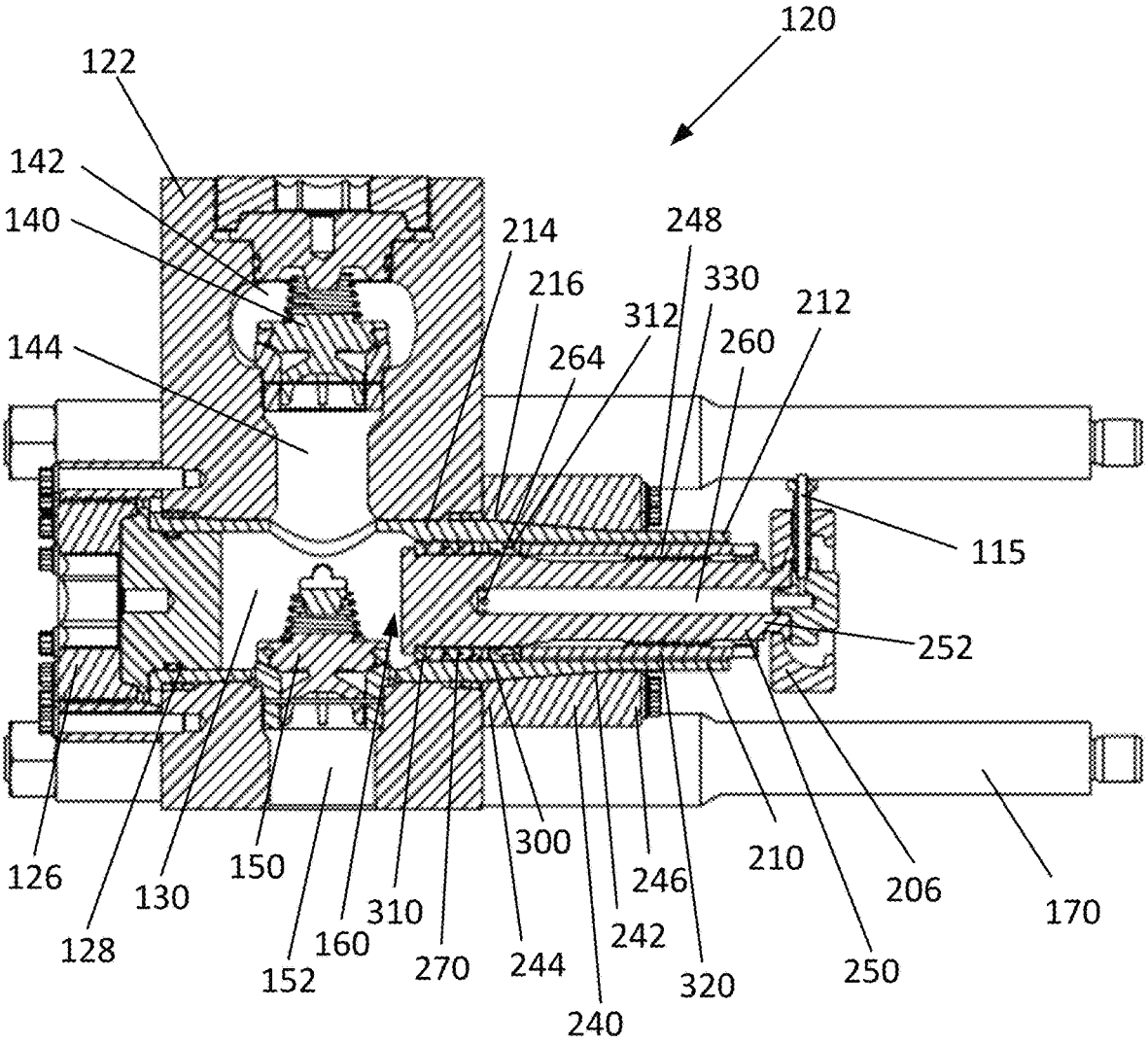
FIG. 6 is a side cross-sectional view of the fluid end and piston assemblies shown in FIG. 3 taken along line A-A in FIG. 5.

Referring to FIG. 6, a cross-sectional side view taken along line A-A in FIG. 5 is illustrated. The fluid end casing 122 of the fluid end 120 is shown in cross-section. Several couplers 170 are illustrated as extending outwardly from opposite sides of the fluid end casing 122. The fluid end casing 122 includes an access bore 128 that is closed by access cover 126. The fluid end casing 122 also includes a cross bore 130 and a discharge bore 144. Located in the discharge bore 144 is a valve or valve component 140 that is biased by a spring to a closed position. When the piston is moved in a pumping or forward direction, fluid is forced from the cross bore 130 into the discharge bore 144 which results in valve 140 unseating and moving to an opened position, at which point the fluid can enter the discharge manifold 142 and exit the fluid end casing 122.

The fluid end casing 122 also includes a suction bore 152 through which fluid enters the fluid end casing 122 and travels to the cross bore 130. A valve or valve component 150 is illustrated in its closed position relative to suction bore 152. The fluid end casing 122 has a piston bore 160 as well. Each of the access bore 128, the discharge bore 144, the suction bore 152, and the piston bore 160 is in fluid communication with and interest at the cross bore 130.

Inserted into the piston bore 160 is a hollow cylindrical liner 210. Liner 210 has a first or outer end 212 and an opposite second or inner end 214. As shown in FIG. 6, the thickness of the liner 210 varies along the length of the liner 210 between end 212 and end 214. Liner 210 has an outer surface or wall 216 and an inner surface or wall 218 that defines an inner diameter of the liner 210. The inner diameter, and thus, the inner surface 218, is constant for nearly the entire length of the inner surface 218. As shown in FIG. 6, the inner surface 218 is constant along the portion of the inner surface 218 along with the piston travels. The inner surface 218 of the liner 210 is the dynamic sealing surface of the piston assembly 200. As discussed above, the inner surface 218 being the dynamic sealing surface results in minimizing surface damage due to drops or being hit by an object because of its location inside of the liner 210.

The outer surface 216 has a varying profile. The liner 210 is thinner proximate to end 212 and thicker generally proximate to end 214. While the outer surface 216 has linear or constant outer diameter portions proximate to ends 212 and 214, the middle portion of the liner 210 and outer surface 216 is tapered.

In this embodiment, the hollow cylindrical liner 210 is retained in its position relative to the fluid end casing 122 by a mounting ring 240. Mounting ring 240 has a tapered inner surface 242 that extends between opposite ends 244 and 246 of the mounting ring 240. The mounting ring 240 is secured to the fluid end casing 122 by several fasteners 248. The tapering of the inner surface 242 matches the tapering of the middle portion of the outer surface 216 of liner 210.

Located inside of the liner 210 are a piston 250, packing 270, a lantern ring 300, a wiper ring 312, and a junk ring 310. The junk ring 310 can be referred to alternatively as a distal ring in view of its location on the piston 250. The piston 250 supports multiple sealing rings that can be adjusted (such as by compression) as they wear out to maintain a good seal. Also positioned inside of the liner 210 is a threaded nut or gland nut 320, the position of which can be adjusted relative to the piston 250. The gland nut 320 is threaded over the piston 250, opposite the compression side, and can be accessed from the cradle of the reciprocating pump 100. This location and arrangement of the gland nut 320 eliminates a threaded hole leak path.

In this embodiment, the outer surface 256 of the piston 250 has a set of threads 258 that are engaged by a set of threads 330 that are located on an inner surface 328 of the gland nut 320. As a result, a user can rotate the gland nut 320 relative to the piston 250, and advance the gland nut 320 forward or further into the bore 160 relative to the piston 250 because of the engagement of threads 330 with threads 258. As the packing 270 wears and begins to leak, a user can rotate the gland nut 320 on the piston 250 to tighten the gland nut 320 to get more useable life out of the packing.

In this embodiment, the piston 250 has an outer end 252 to which connecting member 206 is engaged. The connecting member 206 can also engage a reciprocating member (not shown) to impart movement to the piston 250 as well. The connecting member 206 includes a passageway 115 connected thereto. The piston 250 also includes an internal passageway 260 that extends internally in piston 250.

Figure 7:
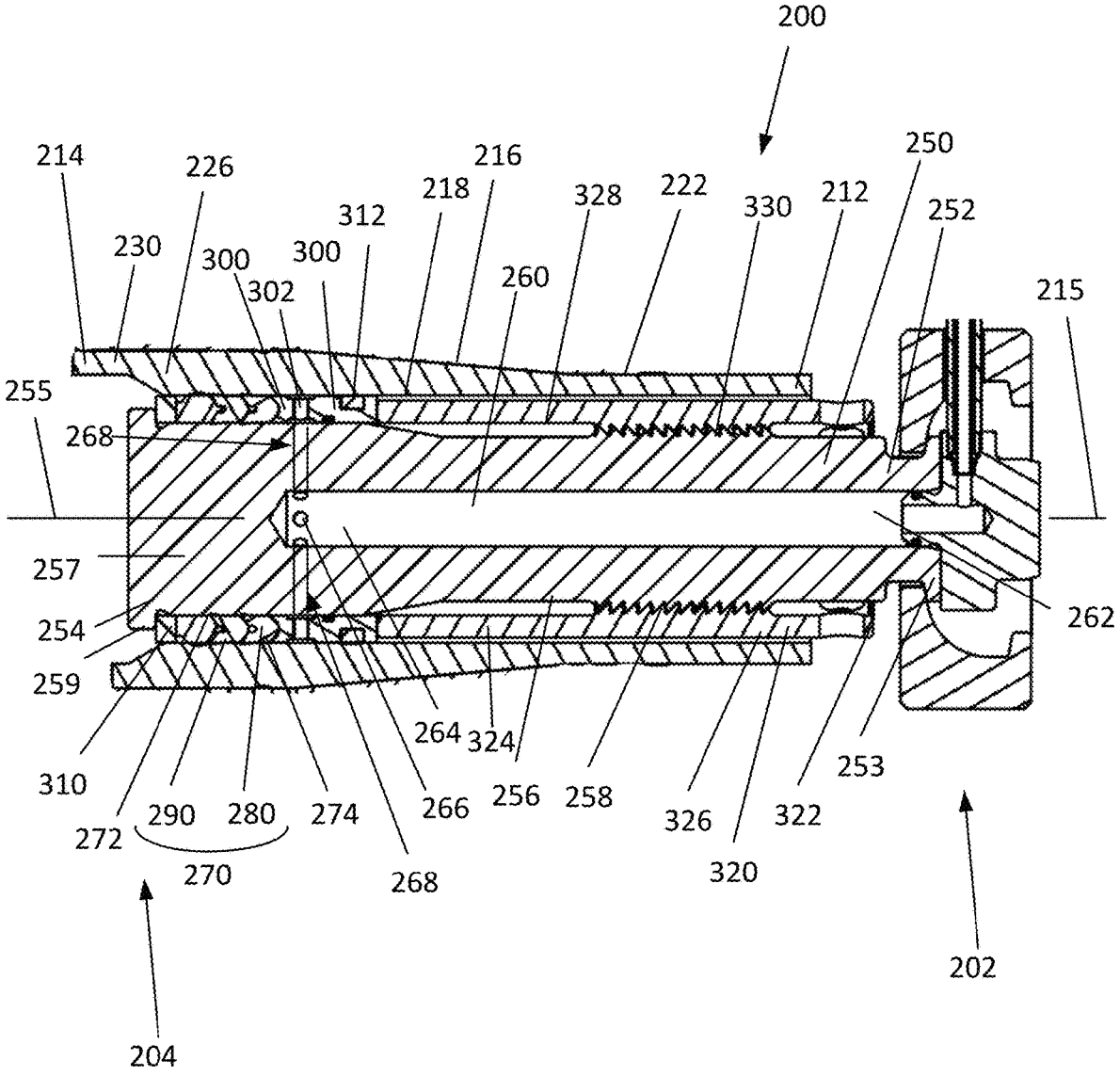
FIG. 7 is a close-up side cross-sectional view of a piston assembly shown in FIG. 6.

Turning to FIG. 7, an enlarged, close-up cross-sectional side view of some of components illustrated in FIG. 6 is shown. Several of the features illustrated in FIG. 6 are also labeled in FIG. 7, but the description of all of those features will not be repeated. The piston assembly 200 has a first end 202 and an opposite second end 204. First end 202 includes the end of the piston 250 that is coupled to a drive component moved by the power end 110. Second end 204 is located in the fluid end casing 122.

Liner 210 has a longitudinal axis 215. As discussed above, the liner 210 has different thickness portions. As shown in FIG. 7, the liner 210 includes two portions 222 and 226 which have different thicknesses. The liner 210 also includes an extending part 230 with a reduced thickness that extends inward from end 214.

The piston 250 has opposite ends 252 and 254. End 252 includes a flange 253 that is captured by the connecting member 206, which in this embodiment, has a ring shaped configuration formed of two parts that are connected to each other by one or more fasteners, such as bolts. The piston 250 has a longitudinal axis 255, which is colinear with the longitudinal axis 215 of the liner 210. The piston 250 includes a thicker portion 257 that is proximate to end 254. Also proximate to end 254 is a flange 259 that extends radially outward. The flange 259 is located in a position in which the junk ring 310 abuts the flange 259.

The opposite ends 322 and 324 of the gland nut 320 are illustrated in FIG. 7. In this embodiment, the gland nut 320 has an outer surface 326 that defines an outer diameter. The outer diameter of the gland nut 320 is less than the inner diameter of the inner surface 218 so that the outer surface 326 and the inner surface 218 do not engage each other. The gland nut 320 moves toward the flange 259 and compresses the packing 270, which in this embodiment includes a first packing element 280 and a second packing element 290, between the lantern ring 300 and the junk ring 310.

The packing elements 280 and 290 are compressed so that an inner surface 272 of the packing 270 is pressed against the outer surface 256 of the piston 250, and an outer surface 274 of the packing 270 is pressed against the inner surface 218 of the liner 210. As the piston 250 reciprocates relative to the fluid end casing 122, the gland nut 320, the packing 270, the lantern ring 300 with the wiper ring 312, and the junk ring 310 travel back and forth with the piston because the gland nut 320 is threaded engaged with the piston 250 and captures the other components between it and the flange 259. As a result, the inner surface 218 is the dynamic sealing surface of the piston assembly because the outer surface 274 of the packing 270, as well as the lantern ring 300 and the junk ring 310, slide along the inner surface 218.

In this embodiment, the internal passageway 260 has an outer end 262 and an inner end 264. Proximate to inner end 264 are several outlets or ports 266 that are in fluid communication with channels 268 that extend radially outward to the lantern ring 300. The fluid in the internal passageway 260 travels through the channels 268 and into ports 302 formed in the lantern ring 300.

Figure 8:
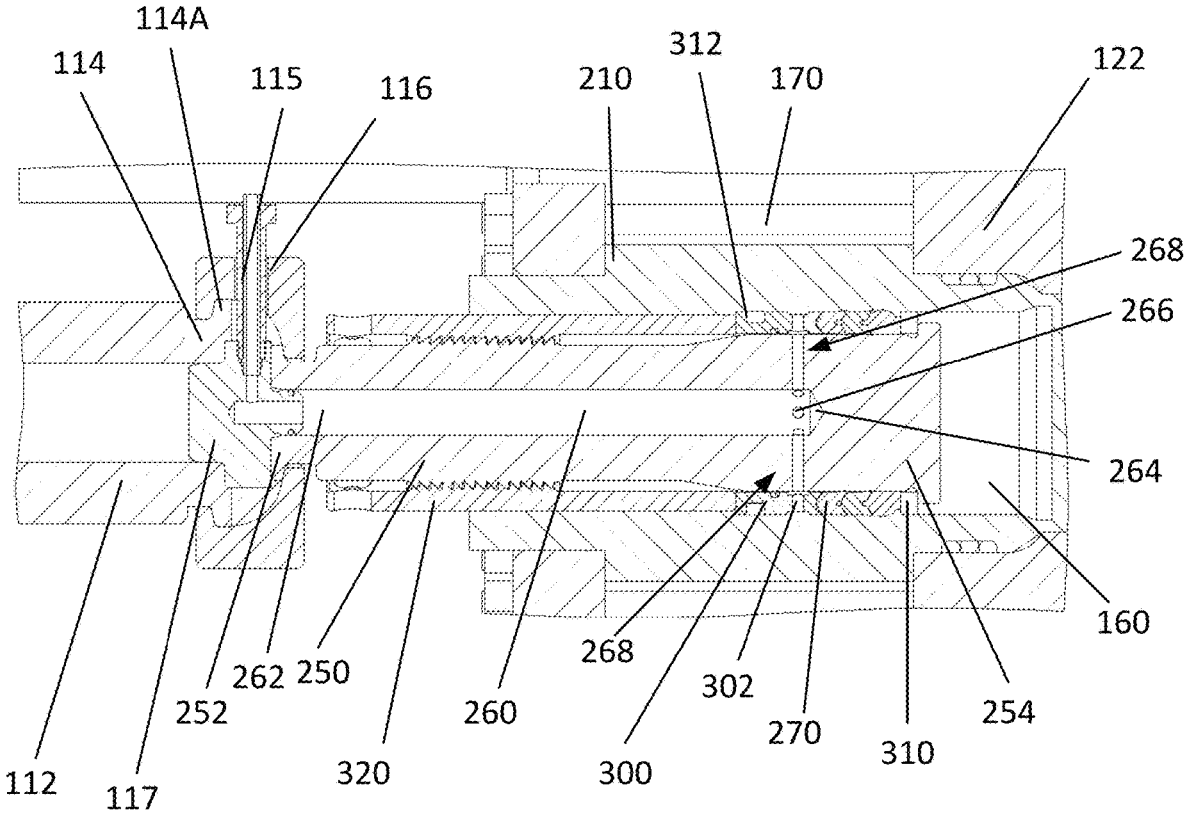
FIG. 8 is a close-up side cross-sectional view of a piston assembly according to another example embodiment.

Turning to FIG. 8, a cross-sectional view of another embodiment of a piston assembly is illustrated. In this embodiment, the liner 210 has a slightly different overall configuration than the liner 210 discussed above relative to FIGS. 1-7. Both liners 210 have portions with different thicknesses, making the thickness of each liner 210 variable along its length.

Additional features of the connection of the piston 250 to the reciprocating member 112 are shown. The reciprocating member 112 has a compression side or end 114 that has a flange 114A around which the coupler 116 is located. A connector 117 is located between the compression end 114 of the reciprocating member 112 and end 252 of the piston 250. Coupled to the connector 117 is an extension defining a channel 115, through which through which lubricating oil or fluid passes to reach the internal passageway 260 that extends through the piston 250.

Similar to the embodiment illustrated in FIGS. 6 and 7, in this embodiment, the internal passageway 260 has an outer end 262 and an inner end 264. Proximate to inner end 264 are several outlets or ports 266 that are in fluid communication with channels 268 that extend radially outward to the lantern ring 300. The fluid in the internal passageway 260 travels through the channels 268 and into ports 302 formed in the lantern ring 300.

The lubricating oil through the lantern ring 300 is more effective at reducing friction, which reduces the heat generated from the start. The reduction of heat generated between the packaging and the liner enables the piston to achieve higher pressures than traditional pistons, resulting in an overall improved performance.

The embodiment illustrated in FIG. 8 has several benefits or features related to the liner configuration. The liner does not extend all of the way through the fluid end cross bore. The liner ends or terminates in a receiving counterbore on the back side of the fluid end body. In addition, the liner is capture by a liner clamp instead of the tapered abutment illustrated in FIGS. 6 and 7.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

The invention claimed is:

1. A piston assembly for a reciprocating pump with a power end and a fluid end, the piston assembly comprising:

a hollow cylindrical liner having a longitudinal axis, a pumping end, and an inner surface, the hollow cylindrical liner being secured in place by a retaining element;

a piston disposed within the hollow cylindrical liner, the piston having its own longitudinal axis and a continuous pumping face, the piston being configured to be coupled with the power end of the reciprocating pump, the piston having an outer surface and an internal passageway extending along its longitudinal axis, the outer surface of the piston being spaced apart from and not in contact with the inner surface of the hollow cylindrical liner, the continuous pumping face having a diameter extending radially outward past the outer surface located proximate to the pumping end of the hollow cylindrical liner; and a packing disposed on the piston and positioned in contact with the outer surface of the piston, and the packing engages the inner surface of the hollow cylindrical liner when the piston is inserted into the hollow cylindrical liner, wherein a fluid can be supplied through the internal passageway.

2. The piston assembly of claim 1, further comprising:

a lantern ring disposed on the piston, the internal passageway having an outlet, wherein the fluid passes through the outlet to the lantern ring.

3. The piston assembly of claim 2, further comprising:

a distal ring disposed on the piston; and a threaded nut disposed on the piston, wherein the packing and the lantern ring are located between the threaded nut and the distal ring.

4. The piston assembly of claim 3, wherein each of the distal ring and the threaded nut is engaged with the outer surface of the piston, and the threaded nut is adjustable so that it can be moved along the outer surface of piston.

5. The piston assembly of claim 4, wherein the threaded nut includes an inner surface with a first set of threads, the outer surface of the piston includes a second set of threads, and the second set of threads and the first set of threads are engageable to facilitate movement of the threaded nut relative to the piston.

6. The piston assembly of claim 1, wherein the packing includes a first packing element and a second packing element.

7. The piston assembly of claim 1, wherein the packing has an outer surface, and the outer surface of the packing engages the inner surface of the hollow cylindrical liner.

8. The piston assembly of claim 1, wherein the hollow cylindrical liner has a first end and a second end opposite to the first end, the hollow cylindrical liner has a thickness between its outer surface and its inner surface, and the thickness varies along the hollow cylindrical liner between the first end and the second end.

9. The piston assembly of claim 8, wherein the hollow cylindrical liner has a first portion that has a first thickness and a second portion that has a second thickness, the second thickness is greater than the first thickness, and a part of the second portion of the hollow cylindrical liner is inserted into a bore of a fluid end.

10. A piston assembly for a reciprocating pump with a power end and a fluid end, the piston assembly comprising:

a hollow cylindrical liner having a longitudinal axis, a pumping end, and an inner surface, the hollow cylindrical liner is retained in its position relative to a fluid end casing by a mounting ring;

a piston disposed within the hollow cylindrical liner, the piston having its own longitudinal axis and a continuous pumping face, the piston being configured to be coupled with the power end of the reciprocating pump, the piston having an outer surface and an internal passageway extending along its longitudinal axis, the outer surface of the piston is not in contact with the inner surface of the hollow cylindrical liner, the continuous pumping face having a diameter extending radially outward past the outer surface located proximate to the pumping end of the hollow cylindrical liner; and a packing disposed on the piston and positioned in contact with the outer surface of the piston, and the packing engages the inner surface of the hollow cylindrical liner when the piston is inserted into the hollow cylindrical liner, wherein a fluid can be supplied through the internal passageway.

11. The piston assembly of claim 10, further comprising:

a lantern ring disposed on the piston, the internal passageway having an outlet, wherein the fluid passes through the outlet to the lantern ring;

a distal ring disposed on the piston; and a threaded nut disposed on the piston, wherein the packing and the lantern ring are located on the outer surface of the piston and between the threaded nut and the distal ring.

12. The piston assembly of claim 11, wherein the threaded nut includes an inner surface with a first set of threads, the outer surface of the piston includes a second set of threads, and the second set of threads and the first set of threads are engageable to facilitate movement of the threaded nut relative to the piston.

13. The piston assembly of claim 11, wherein the piston, the threaded nut, the lantern ring and the packing can be removed collectively as a unit from the hollow cylindrical liner.

14. A reciprocating pump, comprising:

a power end;

a fluid end including a bore formed therein; and a piston assembly having a first end and a second end opposite the first end, the first end of the piston assembly is coupled to the power end, the second end of the piston assembly is coupled to the fluid end, the piston assembly including:

a hollow cylindrical liner having a longitudinal axis, a pumping end, and an inner surface, the hollow cylindrical liner being secured in place by a retaining element;

a piston disposed within the hollow cylindrical liner, the piston having an outer surface, a continuous pumping face having a diameter extending radially outward past the outer surface located proximate to the pumping end of the hollow cylindrical liner, and an internal passageway extending therein, the outer surface of the piston not in contact with the inner surface of the hollow cylindrical liner; and a packing disposed on the piston, the packing engaging the inner surface of the hollow cylindrical liner when the piston is inserted into the hollow cylindrical liner, wherein a fluid can be supplied through the internal passageway.

15. The reciprocating pump of claim 14, further comprising:

a lantern ring disposed on the piston, the internal passageway having an outlet, wherein the fluid passes through the outlet to the lantern ring.

16. The reciprocating pump of claim 15, further comprising:

a distal ring disposed on the piston; and a threaded nut disposed on the piston, wherein the packing and the lantern ring are located between the threaded nut and the distal ring.

17. The reciprocating pump of claim 16, wherein each of the distal ring and the threaded nut is engaged with the outer surface of the piston, and the threaded nut is adjustable so that it can be moved along the outer surface of piston.

18. The reciprocating pump of claim 17, wherein the threaded nut includes an inner surface with a first set of threads, the outer surface of the piston includes a second set of threads, and the second set of threads and the first set of threads are engageable to facilitate movement of the threaded nut relative to the piston.

19. The reciprocating pump of claim 17, wherein the piston, the threaded nut, the lantern ring and the packing can be removed collectively as a unit from the hollow cylindrical liner.

20. The reciprocating pump of claim 14, wherein the hollow cylindrical liner has a first end and a second end opposite to the first end, the hollow cylindrical liner has a thickness between its outer surface and its inner surface, and the thickness varies along the hollow cylindrical liner between the first end and the second end.

* * * * *